US005946735A

United States Patent [19]

Bayes

[11] Patent Number: 5,946,735

[45] Date of Patent: Sep. 7, 1999

[54] QUICK-RELEASE FOOTBALL HELMET CHIN STRAP

[76] Inventor: James E. Bayes, RT 15 Box 455, Huntsville, Tex. 77340

[21] Appl. No.: 09/150,359

[22] Filed: Sep. 9, 1998

[51] Int. Cl.[6] ..... A42B 3/08

[52] U.S. Cl. ..... 2/421; 2/425; 24/442

[58] Field of Search ..... 2/421, 909, 918, 2/410, 424, 425; 24/306, 442

[56] References Cited

U.S. PATENT DOCUMENTS

| | | | |
|---|---|---|---|
| 2,717,235 | 9/1955 | Prober | 204/59 |
| 2,814,043 | 11/1957 | Alesi | 2/421 |
| 2,867,811 | 1/1959 | Jones | 2/3 |
| 3,009,235 | 11/1961 | Mestrai | 28/78 |
| 3,166,761 | 1/1965 | Strohm | 2/3 |
| 3,387,341 | 6/1968 | Mates et al. | 24/73 |
| 3,916,446 | 11/1975 | Gooding | 2/421 |
| 4,051,556 | 10/1977 | Davenport et al. | 2/421 |
| 4,062,068 | 12/1977 | Davenport et al. | 2/421 |
| 4,112,521 | 9/1978 | Uke | 2/452 |
| 4,646,368 | 3/1987 | Infusino et al. | 2/421 |
| 4,651,356 | 3/1987 | Zide | 2/421 |
| 4,686,712 | 8/1987 | Spiva | 2/10 |
| 4,741,054 | 5/1988 | Mattes | 2/421 |
| 4,903,349 | 2/1990 | Arai | 2/421 |
| 5,046,200 | 9/1991 | Feder | 2/452 |
| 5,142,705 | 9/1992 | Edwards | 2/418 |
| 5,347,660 | 9/1994 | Zide et al. | 2/421 |
| 5,381,360 | 1/1995 | Shridhar et al. | 364/746 |
| 5,511,250 | 4/1996 | Field et al. | 2/418 |
| 5,575,017 | 11/1996 | Hefling et al. | 2/418 |
| 5,694,649 | 12/1997 | Hefling et al. | 2/418 |
| 5,809,579 | 9/1998 | Kraemer | 2/421 |

*Primary Examiner*—Michael A. Neas
*Assistant Examiner*—Katherine Moran
*Attorney, Agent, or Firm*—John D. Gugliotta, PE, Esq.

[57] ABSTRACT

Disclosed is a quick-release football helmet chin strap that incorporates the use of a hook and loop fastener to tighten the strap and secure the helmet to the player's head. Intended for use on newly produced helmets and replacing the snap-type fasteners on existing helmets, the use of the hook and loop fasteners eliminates the burden associated with using the snap fasteners during the frequent between-play attachment and detachment.

4 Claims, 5 Drawing Sheets

QUICK-RELEASE FOOTBALL HELMET CHIN STRAP

BACKGROUND OF THE INVENTION

1. Field of the Invention

The present invention relates generally to chin straps used to secure athletic helmets to the head of the wearer, and more specifically to a chin strap for football helmets that provides the capability to attach and release the chin strap quickly and easily.

2. Background and Related Art

Football helmets are commonly used and are required for league play in order to reduce the risk of serious injury that exists due to the severe physical contact that occurs during the game. Players are struck in the head routinely, with a frequency that can reach several occurrences per play, depending on the position. As a result, a great deal of research has been conducted, leading to improvements in head gear technology and methodology that serve to greatly enhance the protective nature of these devices. In one such study, it was discovered that loose fitting helmets are less effective in preventing injury due to the fact that the wearer's head tended to get jarred around, creating impact inside the helmet. As a result, it is common practice to wear a football helmet with the chin strap adjusted for an extremely tight fit in order to maximize the helmet's impact absorbing capabilities. While this practice is effective, it results in discomfort for the wearer and inhibits one's ability to breathe freely through his mouth. As a result, players often remove the chin strap in between plays in order to alleviate this discomfort. However, repeated use of the snap-type fastening means used on conventional football helmets are burdensome to use and often break as a result of frequent use. When this occurs, the player is forced to the sideline for repairs which can be costly to the team where the play is pivotal in the outcome of the game. Furthermore, a penalty can be issued if a player does not secure his chin strap during a play. The present invention solves these problems while allowing the wearer to maintain the requisite degree of helmet security by incorporating the use of a hook and loop fastening means to secure a chin strap to a football helmet. These fasteners are strong, durable, easy to operate and will withstand the rigors and repeated use in a football environment.

A search of the prior art did not disclose any patents that read directly on the claims of the instant invention, however several references, pertaining mainly to helmet chin straps and more specifically football helmet chin straps, were considered related.

Several patents disclose conventional designs for football helmet chin straps. In two-point chin strap models, a chin support cup is attached to a single securing strap extending from each side of the support cup and attaching to the helmet via a snap button securing device. In four-point chin strap models, a chin support cup includes a pair of straps that connect to the helmet laterally, along the side of the helmet at chin-level, and a pair of straps connect to the helmet in a mostly vertical manner, approximately at eye-level:

U.S. Pat. No. 2,867,811 issued in the name of Jones;

U.S. Pat. No. 3,166,761 issued in the name of Strohm;

U.S. Pat. No. 4,051,556 issued in the name of Davenport;

U.S. Pat. No. 4,062,068 issued in the name of Davenport et al.;

U.S. Pat. No. 4,646,368 issued in the name of Infusino et al.;

U.S. Pat. No. 4,651,356 issued in the name of Zide; and

U.S. Pat. No. 5,347,660 issued in the name of Zide et al.

The primary purpose of these devices is to secure the helmet to the head in a manner so as to minimize the movement of the helmet upon impact. All of these devices disclose the use of snap-type devices as the means by which the strap is secured to the helmet. This being the case, it is obvious that none of these disclosures anticipate a quick-attaching means such as that of the present invention nor considers the burdens and maintenance problems associated with the use of snap-type devices as a motivating factor in the development of the individual chin strap designs. While these disclosures do anticipate the need to adjust the chin straps so as to allow for a tight fit, they neglect to address the inherent problems associated with the use of snap-type fasteners, i.e. difficult operation and the tendency to malfunction or break after repeated use.

U.S. Pat. Nos. 5,694,649 and 5,575,017, both issued in the name of Hefling et al., describe an elastic strapping means used to secure a hat or helmet in place on the wearer's head. Intended for use in a baseball batting or catcher's helmet, an elastic strap extends across the interior cavity of the helmet shell, from front to back in a V-shaped configuration. The wearer places the helmet on his/her head passing in between the two lengths of strapping, causing them to become displaced. The elastic quality of the strapping creates a friction fit with the wearer's head, securing the helmet thereto. U.S. Pat. No. 5,511,250, issued in the name of Field et al. and U.S. Pat. No. 5,142,705, issued in the name of Edwards disclose strapping means used to secure a batting or catcher's helmet in place on the wearer's head. Both devices consist of an adjustable annular strap that circumscribes the interior cavity of the helmet, adjusting to fit the exact size of the wearer's head. The Field et al. device incorporates an adjustment wheel that increases/decreases the size of the strap when turned. The Edwards device incorporates a hook and loop fastening means to adjust the strap.

All of these devices exhibit clear differences, both in spirit and function, from the present invention and thus do not preclude its novelty nor anticipate its design. There is no mention in the disclosures of any use in conjunction with football helmets or other like protective devices. The degree to which these devices secure the helmet to the wearer's head is slight in comparison to that of the present invention. It is obvious from the disclosure that the helmet can easily be knocked off or even fall off in situations of rigorous physical activity. The Hefling et al. disclosures do anticipate the use of a chin strap to further secure the helmet to the wearer's head, however the helmet incorporates a conventional snap-type fastening means to secure the chin strap and, regardless, neither the chin strap nor the fastening means are claimed as part of the invention. Although the Edwards invention does incorporate a hook and loop fastening means to enable adjustment in a quick and easy manner, the motivation behind the invention differs substantially from that of the present invention and by no means anticipates the novel use or design of the present invention.

U.S. Pat. No. 4,112,521, issued in the name of Uke and U.S. Pat. No. 5,046,200, issued in the name of Feder disclose quick-adjustment straps for underwater diving masks in which a hook and loop fastening means is used to allow the user to secure, adjust and remove the mask. While the motivation behind these inventions is to provide a fast and easy way in which to secure the mask, use of such a system for football helmets or the like is not anticipated in the disclosure.

While several features exhibited within these references are incorporated into this invention, alone and in combination with other elements, the present invention is sufficiently different so as to make it distinguishable over the prior art.

SUMMARY OF THE INVENTION

The quick-release football helmet chin strap is a modification of conventional football helmet strap designs that incorporates the use of a hook and loop fastener to tighten the strap and secure the helmet to the player's head. Intended for use on newly produced helmets and replacing the snap-type fasteners on existing helmets, the use of the hook and loop fasteners eliminates the burden associated with using the snap fasteners during the frequent between-play attachment and detachment. Use of the quick-release football helmet chin strap also eliminates the problems associated with failure of snap fasteners due to repetitive use. Each chin strap is fit with a length of loop component material of a hook and loop fastener followed by a length of hook component material along the end portion of the strap, replacing the female snap connector component used on conventional models. The male snap connector component typically attached to the helmet is replaced by a hinge buckle device. The strap is passed through the buckle and pulled tight, wrapping around the ring so that the end of the strap is drawn parallel with the portion of the strap that has not yet reached the buckle. Positioned as such, the hook and loop components of the hook and loop fastener can be pressed together, securing the strap in place. In the retrofit design, the hinge buckle device is fit with a female component of a snap connector so that it can be connected to the helmet and used in conjunction with the quick-release football helmet chin strap.

It is therefore an object of the present invention to provide a quick-release football helmet chin strap that replaces the typical snap-type connectors used in conventional football helmet chin strap designs.

It is another object of the present invention to provide a quick-release football helmet chin strap that eliminates the burdens associated with the frequent attachment/detachment of the typical snap-type connectors used in conventional football helmet chin strap designs.

It is another object of the present invention to provide a quick-release football helmet chin strap that eliminates the burdens associated with the failure due to excessive use of the typical snap-type connectors used in conventional football helmet chin strap designs.

It is another object of the present invention to provide a quick-release football helmet chin strap that incorporates the use of a hook and loop fastening device that is easy to use and will provide a strong, secure attachment.

It is another object of the present invention to provide a quick-release football helmet chin strap that incorporates the use of a hook and loop fastening device that will withstand frequent, repetitive use without failure.

Finally, it is an object of the present invention to provide a quick-release football helmet chin strap that includes a retrofit design in which a helmet fit with snap-type connectors can be converted for use with the quick-release design.

LIST OF REFERENCE NUMBERS

20 Quick-Release Chin Strap
21 Chin Cup
22 Lateral Support Strap
23 Angular Support Strap
24 Chin Engaging Aperture
25 Mesh Material
26 Stitching
30 Loop Component Material
31 Hook Component Material
35 Hinge Buckle
36 Base Plate
37 First Strap Ring
37*a* Second Strap Ring
38 Fastening Aperture
39 Strap Ring Support Sleeve
40 Straight Bar Portion
45 Strap
46 Hook And Loop Fastening Device
50 Snap Connector
51 Rivet
55 Football Helmet

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
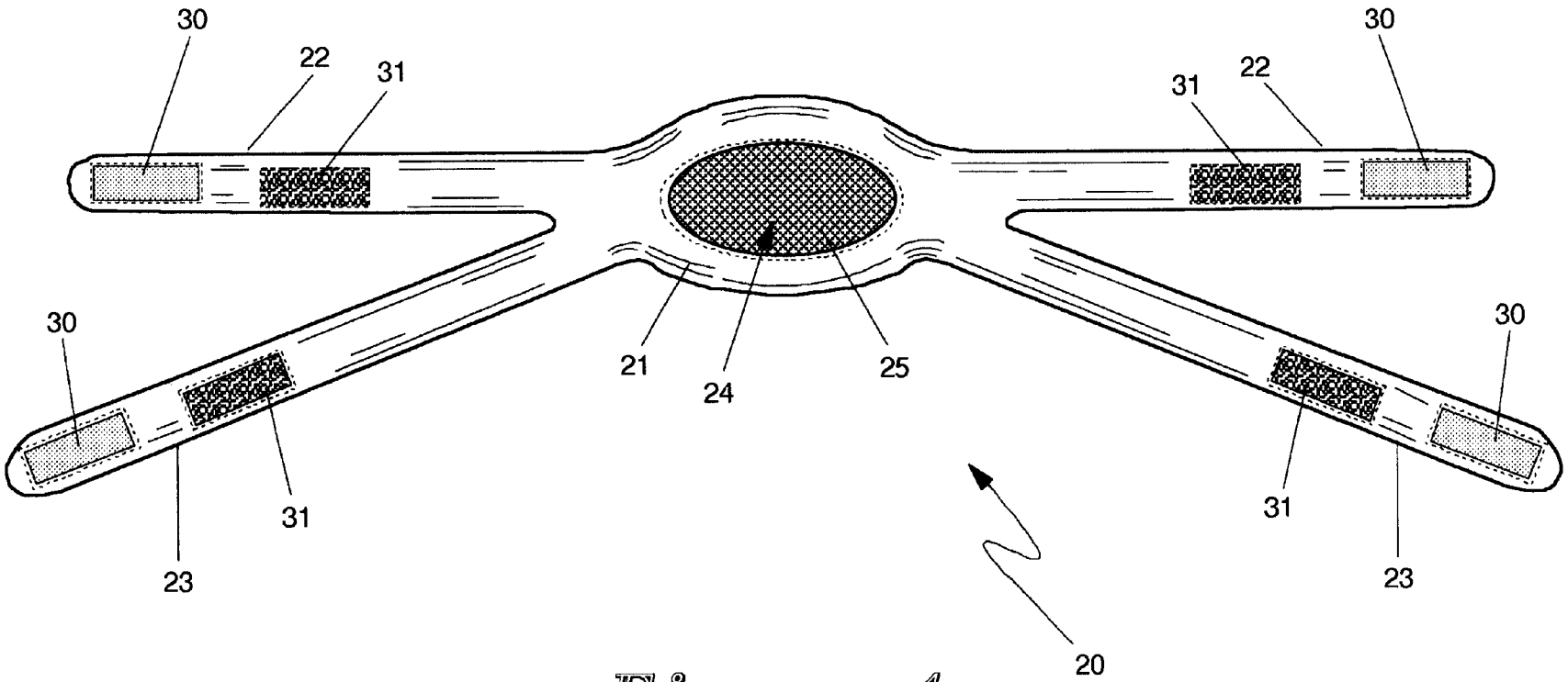
FIG. 1 is a front view of the quick-release football helmet chin strap, according to the preferred embodiment of the present invention.
Figure 2:
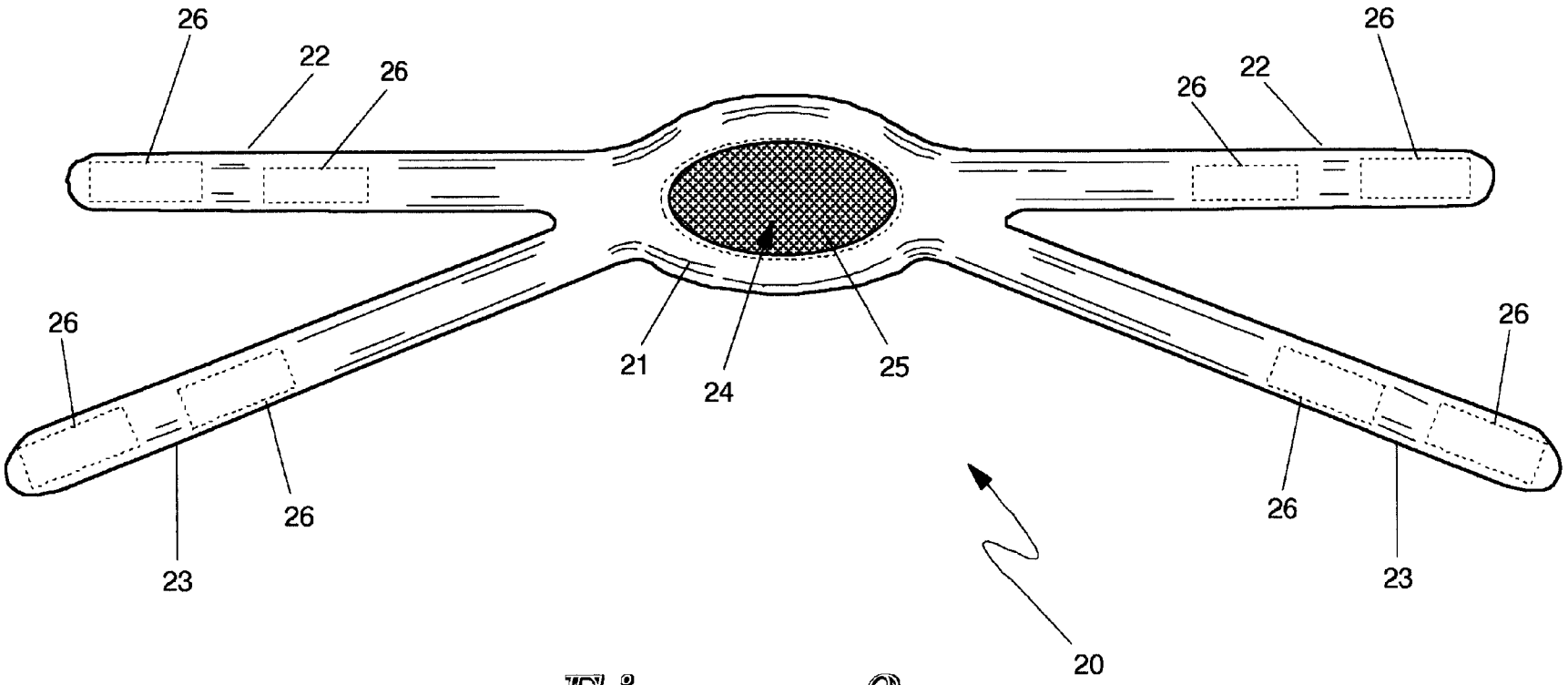
FIG. 2 is a rear view of the quick-release football helmet chin strap, according to the preferred embodiment of the present invention.

Referring to FIGS. 1–2, the quick-release football helmet chin strap, hereinafter quick-release chin strap 20, is depicted according to the preferred embodiment of the present invention. The quick-release chin strap 20 consists of an oval-shaped chin cup 21 with a pair of lateral support straps 22 extending laterally, and a pair of angular support straps 23 extending down at an acute angle from the lateral support straps 23. The quick-release chin strap 20 is constructed of a lightweight, strong, flexible, inelastic material, allowing it to fit the contour of the wearer's face and chin (not shown). The chin cup 21, designed to engage and conform with the shape of the wearer's chin, has an oval shaped chin engaging aperture 24 cut in the strap material and filled with a soft, air-permeable mesh material 25, secured to the strap material via stitching 26 or other suitable fastening means, that provides a comfortable fit and allows the skin to breathe. The back side of each of the lateral support straps 22 and the angular support straps 23 is fit with a rectangular length of loop component material 30 of a hook and loop fastener, at the end thereof, and a rectangular length of hook component material 31 of a hook and loop fastener adjacent to the loop component material 30 with a small gap therebetween, secured to the strap via stitching 26 or other suitable fastening means.

Figure 3:
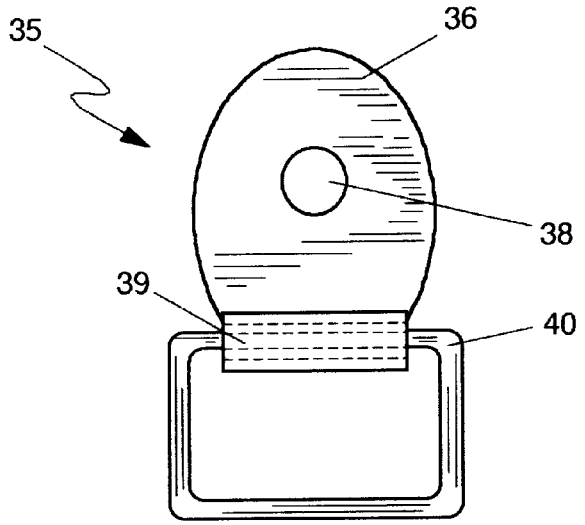
FIG. 3 is a front view of the hinge buckle device for use in conjunction with the quick-release football helmet chin strap, according to the preferred embodiment of the present invention.
Figure 4:
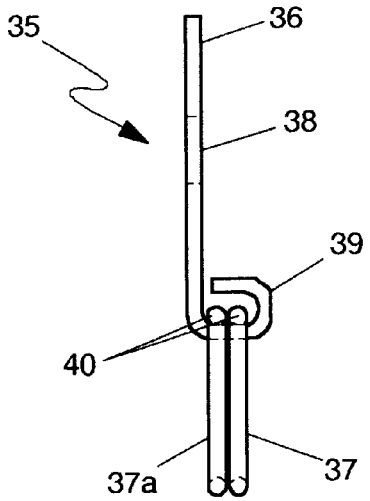
FIG. 4 is a side view of the hinge buckle device for use in conjunction with the quick-release football helmet chin strap, according to the preferred embodiment of the present invention.

Referring now to FIGS. 3–4, depicted is a hinge buckle 35 for use in conjunction with the quick-release chin strap 20, according to the preferred embodiment of the present invention. The hinge buckle 35 consists of a base plate 36 that provides hinged support for a first strap ring 37 and a second strap ring 37*a*. The base plate 36 includes a generally circular fastening aperture 38 through which a fastener (not shown), such as a rivet, screw, bolt or other like device, can be passed in order to secure the hinge buckle 35 to a football helmet (not shown). The base plate 36 is rolled along one edge forming a strap ring support sleeve 39 through which the straight bar portion 40 of the first strap ring 37 and second strap ring 37*a* is passed, creating a hinged attachment wherein the strap ring rotates about the straight bar portion 40. The hinge buckles 35 are attached to the football helmet (not shown) on a one-for-one basis with the lateral support straps 22 and the angular support straps 23, allowing for the individual attachment thereof. The placement of the hinge buckles 35 on the football helmet is discussed in further detail hereinbelow.

Figure 5:
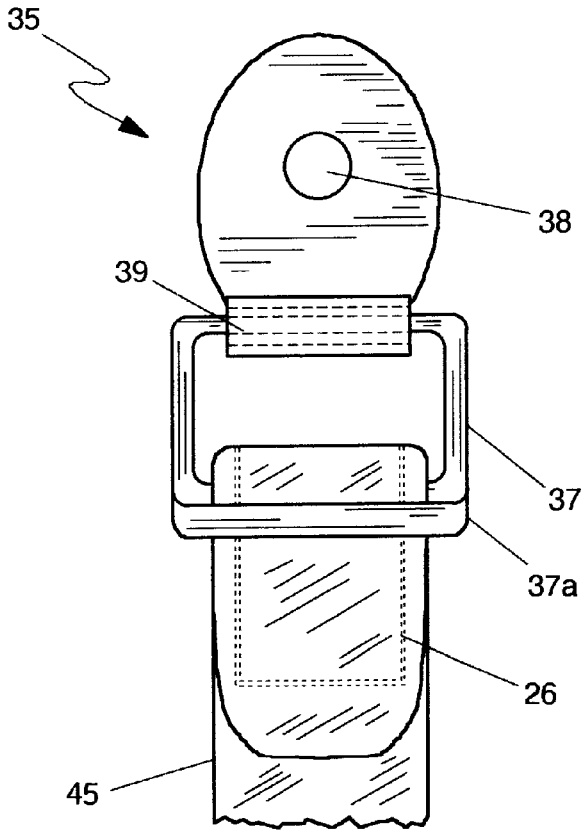
FIG. 5 is a front view of the hinge buckle device depicting its use in combination with the quick-release football helmet chin strap, according to the preferred embodiment of the present invention.
Figure 6:
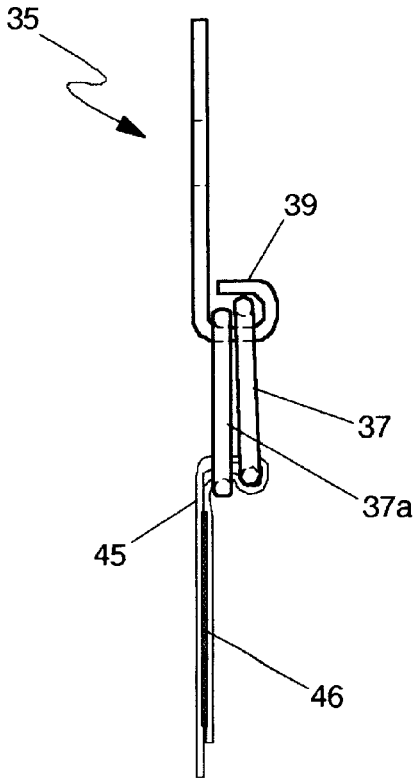
FIG. 6 is a side view of the hinge buckle device depicting its use in combination with the quick-release football helmet chin strap, according to the preferred embodiment of the present invention.

Referring now to FIGS. 5–6, depicted is the hinge buckle 35 used in combination with the quick-release chin strap 20, according to the preferred embodiment of the present invention. For explanatory purposes, the use of the hinge buckle 35 in conjunction with the quick-release chin strap 20 will be described in generic terms of a strap 45, due to the fact that the use of the lateral chin strap 22 and the angular chin strap 23 is identical. The strap 45 is passed through both the first strap ring 37 and the second strap ring 37*a* with the loop component material 30 and the hook component material 31 facing the strap ring surfaces. The strap 45 wraps around the outside of the first strap ring 37 and is looped back through the inside of the second strap ring 37*a*. Positioned as such, the loop component material 30 and the hook component material 31 are pressed together, forming a hook and loop fastening device 46, thus securing the strap 45 to the hinge buckle 35. The dual strap ring configuration of the hinge buckle 35 also serves to strengthen the degree to which the strap 45 is secured mechanically, thus enhancing its effectiveness. Installed in the aforementioned manner, tension drawn along the longitudinal axis of the strap 45 will draw the first strap ring 37 and the second strap ring 37*a* together, sandwiching the strap 45 therebetween and thus creating strength enhancing frictional forces.

Figure 7:
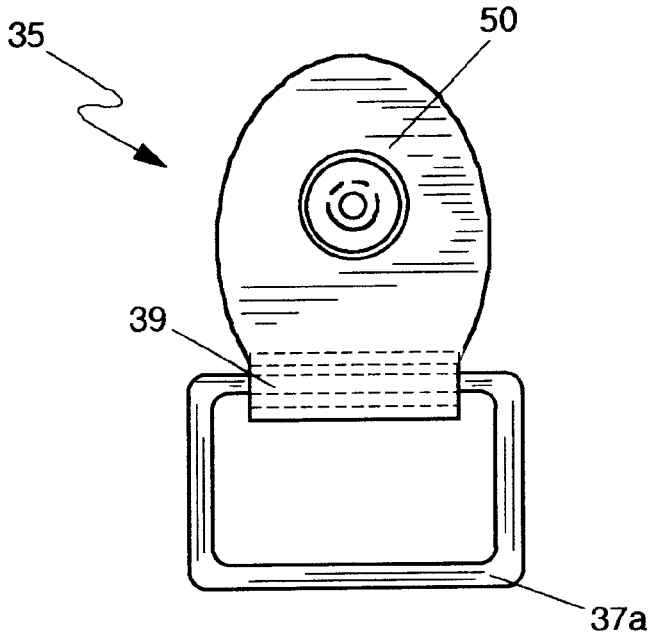
FIG. 7 is a rear view of the hinge buckle device, fit with a female snap-type compression connector, for use in conjunction with the quick-release football helmet chin strap, according to an alternate embodiment of the present invention.
Figure 8:
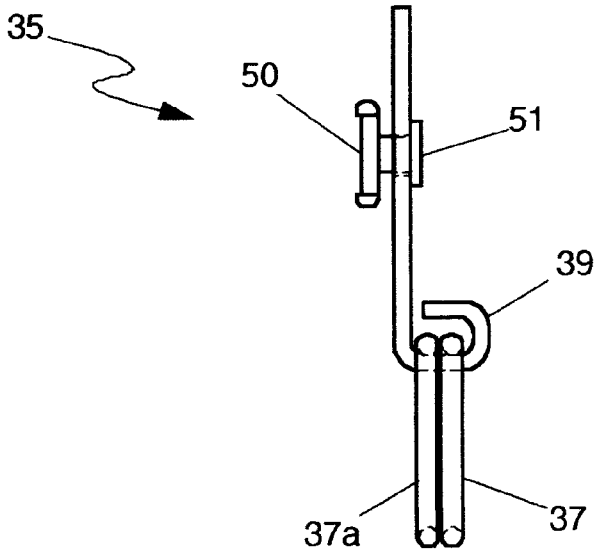
FIG. 8 is a side view of the hinge buckle device, fit with a female snap-type compression connector, for use in conjunction with the quick-release football helmet chin strap, according to an alternate embodiment of the present invention.
Figure 9:
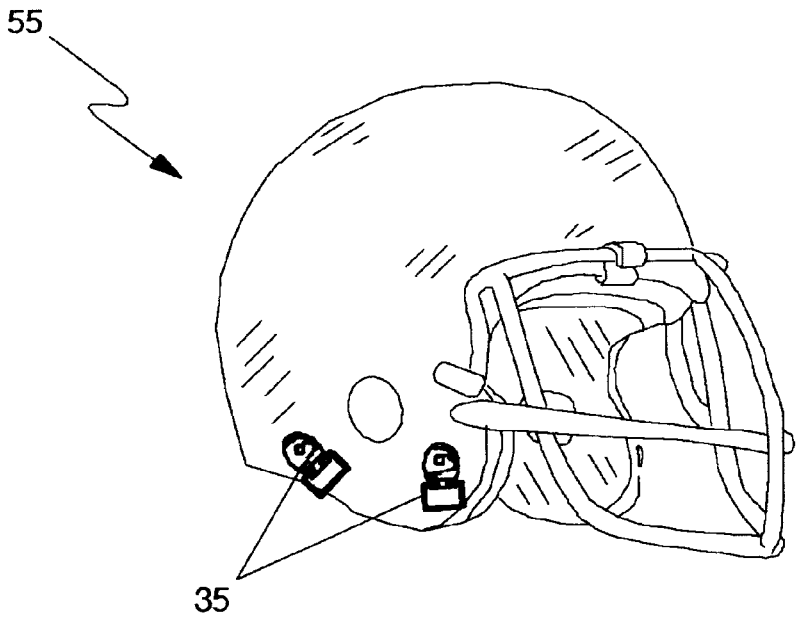
FIG. 9 is a perspective view of a conventional football helmet fit with the hinge buckle device, for use in conjunction with the quick-release football helmet chin strap, according to the preferred embodiment of the present invention.
Figure 10:
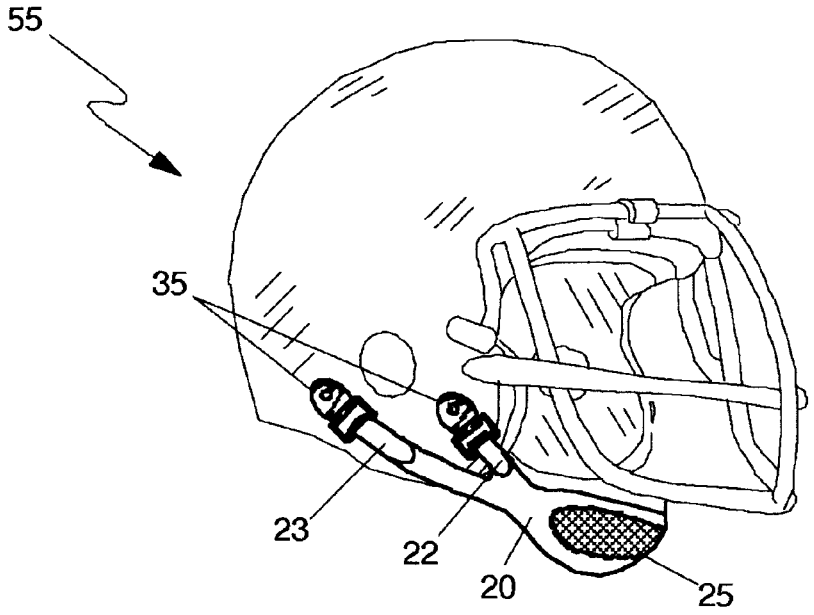
FIG. 10 is a perspective view of a conventional football helmet fit with the hinge buckle device, depicting its use in combination with the quick-release football helmet chin strap, according to the preferred embodiment of the present invention.

Referring now to FIGS. 7–8, in an alternate embodiment, the hinge buckle 35 is fit with a snap-type compression connector, hereinafter snap connector 50, in order to retrofit existing football helmets that use snap-type chin straps, so that they can be used with the quick-release chin strap 20 disclosed in the present invention. In this embodiment, a snap connector 50 is secured to the fastening aperture 38 via a rivet 51 or other like fastener. The snap connector 50 consists of the "female" component and is of a size and design so as to mate with the "male" component found on most conventional football helmets (not shown). As such, the hinge buckle 35 is installed simply by snapping it onto the male component, securing it in place on the football helmet. However, regardless of whether the hinge buckle 35 is connected to the helmet via a fastener placed through the fastening aperture 38 or via the snap connector 50, the operation of the quick-release chin strap 20 is identical and essentially equally effective.

2. Operation of the Preferred Embodiment

Referring now to the Figures, the quick-release chin strap 20 is used in the following manner. The hinge buckle 35 is secured to a football helmet 55 by placing a fastener through the fastening aperture 38 in the case where the helmet has not been fit with a snap-type connector, or by using the snap connector 50 in the case where the helmet has previously been fit with a snap-type connector. Regardless of the means by which the hinge buckle 35 is attached to the football helmet 55, the use of the quick-release chin strap 20 therewith is identical to that described above in reference to FIGS. 5–6. The incorporation of the hook and loop fastening device 46 allows for the quick, easy and repetitive use that is typical during a football game while eliminating the difficulties associated with applying the snap-type connectors typically found on conventional football helmets. Furthermore, use of the quick-release chin strap 20 eliminates the occurrence of snap-type connector failures by minimizing or eliminating their use altogether.

While the preferred embodiments of the invention have been shown, illustrated, and described, it will be apparent to those skilled in this field that various modifications may be made in these embodiments without departing from the spirit of the present invention. By way of example, and not by limitation, one could envision the use of a single strap ring in conjunction with the hinge buckle 35. Although this would reduce the frictional securing force created by a two-buckle configuration, it would increase the ease with which the quick-release chin strap 20 could be used. Also, it is realized that strap configurations vary, for example by strap number wherein two-strap or six-strap variations exist and, as a result, the description of the present invention in terms of a four-strap chin strap design is for descriptive purposes only and is by no means meant to limit the scope of the present invention.

Similarly, the teachings of the present disclosure can be adapted, by one skilled in the art and with the benefit of the above teachings, for use in areas other than those including football helmet chin straps. Again by way of example, and not limitation, one could envision incorporation of the present invention in a variety of protective headgear, including hockey helmets, baseball batting helmets, motorcycle helmets, etc.

It can therefore be seen that the utilitarian benefits taught herein can be broadly applied. It is for this reason that the scope of the invention is set forth in and is to be limited only by the following claims.

What is claimed is:

1. A quick-release chin strap for football helmets, said quick-release chin strap comprising:

a chin strap of unitary construction having an oval-shaped chin cup with a pair of lateral support straps extending laterally from each end thereof, and a pair of angular support straps extending down at an acute angle from said lateral support straps, said chin cup being concave in shape forming a chin-engaging cavity;

a hook and loop fastening means comprising a length of hook component material adjacent to a length of loop component material, said hook and loop fastening means attached to said lateral support straps and said angular support straps on the surface opposite that of said chin-engaging cavity; and a buckling means having a base plate with a top side opposite a bottom side, said base plate having first and second strap rings pivotally attached to said top side in a concentric fashion, and a snap-type fastener attached to said bottom side;

whereby said snap-type fasteners are used to secure said buckling means to a conventional football helmet in positions of lateral and angular support, allowing said chin strap to be secured to said helmet by passing said lateral and angular support straps individually through said buckling means, wrapping around and exiting in between said first and second strap rings, said lateral and angular support straps being folded so as to mate said hook component material and said loop component material and engaging said hook and loop fastening means.

2. The quick-release chin strap of claim 1 wherein said lateral and angular support straps create multidirectional securing forces capable of being applied and removed quickly and easily by operation of said hook and loop fastening means.

3. The quick-release chin strap of claim 1 wherein the tension of said lateral and angular support straps can be modified quickly and easily by operation of said hook and loop fastening means.

4. The quick-release chin strap of claim 1 wherein said chin cup further comprises a padded breathable construction providing additional comfort and protection.

* * * * *